US005232530A

United States Patent [19]

Malmquist et al.

[11] Patent Number: 5,232,530

[45] Date of Patent: Aug. 3, 1993

[54] METHOD OF MAKING A THICK SHINGLE

[75] Inventors: Alfred B. Malmquist; Matti Kiik, both of Dallas, Tex.

[73] Assignee: Elk Corporation of Dallas, Dallas, Tex.

[21] Appl. No.: 864,139

[22] Filed: Apr. 6, 1992

Related U.S. Application Data

[63] Continuation of Ser. No. 340,259, Apr. 19, 1989, abandoned, which is a continuation-in-part of Ser. No. 128,586, Dec. 4, 1987, abandoned.

[51] Int. Cl.[5] ..... B32B 31/06; B32B 31/18; E04D 1/28

[52] U.S. Cl. ..... 156/78; 52/309.9; 52/558; 52/560; 156/79; 156/182; 156/250

[58] Field of Search ..... 156/78, 79, 182, 250, 156/256; 427/187; 428/144, 306.6, 308.4, 318.4, 489; 52/309.4, 309.8, 309.9, 554, 555, 556, 557, 558, 559, 560

[56] References Cited

U.S. PATENT DOCUMENTS

| | | | |
|---|---|---|---|
| 1,310,082 | 7/1919 | Hose | 52/559 |
| 1,722,702 | 7/1929 | Kirschbraun et al. . | |
| 1,756,989 | 5/1930 | Overbury . | |
| 1,973,931 | 9/1934 | Robinson | 52/560 |
| 2,009,617 | 7/1935 | Harshberger | 108/7 |
| 2,101,589 | 12/1937 | MacLean | 20/5 |
| 2,106,624 | 1/1938 | Ray | 52/556 |
| 2,142,181 | 1/1939 | Croce | 108/7 |
| 2,170,534 | 8/1939 | McNutt | 108/7 |
| 2,356,570 | 8/1944 | Deuchler | 117/5 |
| 2,705,209 | 3/1955 | Rowe | 154/51 |
| 2,724,872 | 11/1955 | Herbes | 20/5 |
| 2,863,405 | 12/1958 | Leibrook et al. | 108/7 |
| 3,372,083 | 3/1968 | Evans | 161/190 |
| 3,467,572 | 9/1969 | Ahramjian | 161/190 |
| 3,468,092 | 9/1969 | Chalmers | 52/543 |
| 3,613,328 | 10/1971 | Morgan et al. | 52/555 |
| 3,619,343 | 11/1971 | Freeman | 428/489 |
| 3,624,975 | 12/1971 | Morgan | 52/105 |
| 3,731,449 | 5/1973 | Kephart | 52/631 |
| 3,852,934 | 12/1974 | Kirkhuff | 52/539 |
| 3,921,358 | 11/1975 | Bettoli | 52/314 |
| 4,019,938 | 4/1977 | Forrester | 156/78 |
| 4,021,981 | 5/1977 | Van Wagoner | 52/309.13 |
| 4,028,450 | 6/1977 | Gould | 264/45.5 |
| 4,045,265 | 8/1977 | Tajima | 156/71 |
| 4,065,899 | 1/1978 | Kirkhuff | 52/309.8 |
| 4,122,230 | 1/1978 | Lowell | 428/280 |
| 4,137,198 | 1/1979 | Sachs | 521/154 |

(List continued on next page.)

FOREIGN PATENT DOCUMENTS

| | | | |
|---|---|---|---|
| 0602248 | 7/1960 | Canada | 52/55 |
| 0609501 | 7/1964 | Canada | 52/232 |
| 0105177 | 8/1966 | Netherlands | 52/557 |

OTHER PUBLICATIONS

Residential Asphalt Roofing Manual, 1984, pp. 1-60.
Catalog Entry of Bird & Son in 1977 Sweets Catalog.

*Primary Examiner*—Michael W. Ball
*Assistant Examiner*—Steven D. Maki
*Attorney, Agent, or Firm*—Richards, Medlock & Andrews

[57] ABSTRACT

An approved roofing shingle (10) and a method for its manufacture, are disclosed. The shingle incorporates an upper layer (12) of conventional asphaltic composite roofing material and a lower layer (14) of a polymer foam having a thickness between 1/16 inches and one inch. The foam effectively thickens the shingle to give a layered appearance to a roof using the shingle. The polymer foam can be applied by a free blown or froth process, or preformed and adhered to the composite material sheet by adhesive techniques.

8 Claims, 1 Drawing Sheet

U.S. PATENT DOCUMENTS

| | | | |
|---|---|---|---|
| 4,186,236 | 1/1980 | Heitmann | 428/291 |
| 4,188,763 | 2/1980 | Thiis-Evensen | 52/557 |
| 4,191,722 | 3/1980 | Gould | 52/309.1 |
| 4,195,461 | 4/1980 | Thiis-Evensen | 52/557 |
| 4,226,069 | 10/1980 | Hinds | 52/521 |
| 4,268,572 | 5/1981 | Toland | 428/281 |
| 4,288,959 | 9/1981 | Murdock | 52/518 |
| 4,301,633 | 11/1981 | Neumann | 52/309.4 |
| 4,374,687 | 2/1983 | Yamamoto | 156/71 |
| 4,396,686 | 8/1983 | Fiorio | 428/623 |
| 4,399,186 | 8/1983 | Lauderback | 428/489 |
| 4,405,680 | 9/1983 | Hansen | 428/489 |
| 4,434,589 | 3/1984 | Freiborg | 52/57 |
| 4,465,792 | 8/1984 | Carr et al. | 521/138 |
| 4,470,237 | 9/1984 | Lincoln | 52/420 |
| 4,521,478 | 6/1985 | Hageman | 156/71 |
| 4,565,724 | 1/1986 | Smits | 428/138 |
| 4,571,356 | 2/1986 | White et al. | 428/489 |
| 4,572,865 | 2/1986 | Gluck | 428/309.9 |
| 4,599,258 | 7/1986 | Hageman | 428/140 |
| 4,706,435 | 11/1987 | Stewart | 52/533 |
| 4,717,614 | 1/1988 | Bondoc | 428/143 |
| 4,817,358 | 4/1989 | Lincoln et al. | 52/557 |
| 4,920,721 | 5/1990 | Pressotti et al. | 52/518 |

METHOD OF MAKING A THICK SHINGLE

CROSS-REFERENCED TO RELATED APPLICATION

This application is a continuation of application Ser. No. 340,259, filed on Apr. 19, 1989, now abandoned, which is a continuation-in-part of U.S. patent application Ser. No. 128,586, filed Dec. 4, 1987 now abandoned.

TECHNICAL FIELD

This invention relates to an improved roofing product, and in particular to a thickened conventional asphalt roofing shingle to enhance the appearance of a roof.

BACKGROUND OF THE INVENTION

The vast majority of home roofing is done with either an asphalt composite shingle or a wood shingle. The composite shingle has significant cost, service life and flammability advantages over the wood shingle. However, the wood shingle is seen by many to be a much more desirable roofing material for aesthetic purposes.

One important aesthetic advantage of the wood shingle is its greater thickness relative to the composite shingle. This provides a pleasing layered look to the roof. While composite shingles could be made thicker, to compare in thickness with the wood shingle, the increase in weight would be unacceptable. Even so, it would be a significant advantage to combine the nonflammable, inexpensive features of the composite shingle with the attractive layering effect of the wooden shingle.

SUMMARY OF THE INVENTION

In accordance with one aspect of the present invention, an improved roofing shingle is provided. The roofing shingle includes a first layer of asphaltic roof material, the layer having a granule impregnated surface for exposure to the elements and an under side. The shingle further includes a first layer or polymer foam material bonded to the under side of the first layer of asphaltic roof material to effectively thicken the shingle and enhance the appearance of a roof using the shingle. The shingle may further include a second layer of asphaltic composite roofing material having a surface for exposure to the elements and an underside, said surface of said second layer of asphaltic composite roofing material bonded to the underside of said first layer of polymer foam and a second layer of polymer foam bonded to the underside of said second layer of asphaltic composite roofing material. In a modification, the shingle can be made of multiple layers of asphaltic roof material and polymer foam material, with the uppermost layer of roof material and foam material cut away in selected areas to expose an underlying layer of roof material and present a pleasing shape to the shingle.

In accordance with another aspect of the present invention, the polymer layer has a thickness between about 1/16 inch to one inch. In accordance with another aspect of the present invention, the polymer foam is a urethane foam.

In accordance with yet another aspect of the present invention, a method is provided for forming a sheet of conventional asphaltic shingle material and attaching a layer of polymer foam to the under side of the sheet of asphaltic shingle material. In one aspect, the forming of the polymer foam includes a free blown process. In another aspect, a froth process is used. In a final aspect, a pre-foamed polymer can be adhered to the conventional asphaltic shingle material by flame adherence or adhesive adherence.

BRIEF DESCRIPTION OF THE DRAWINGS

For a more complete understanding of the present invention and the advantages thereof, reference is now made to the following description taken in conjunction with the accompanying drawings, in which.

DETAILED DESCRIPTION

With reference now to the accompanying FIGURES and the following Detailed Description, the present invention provides an improved method of forming a roofing shingle and an improved roofing shingle which combines the advantages of the conventional asphalt composite roof shingle and the enhanced thickness of a wood shingle, as well as providing advantages not found in either a composite or wood shingle construction.

Figure 1:
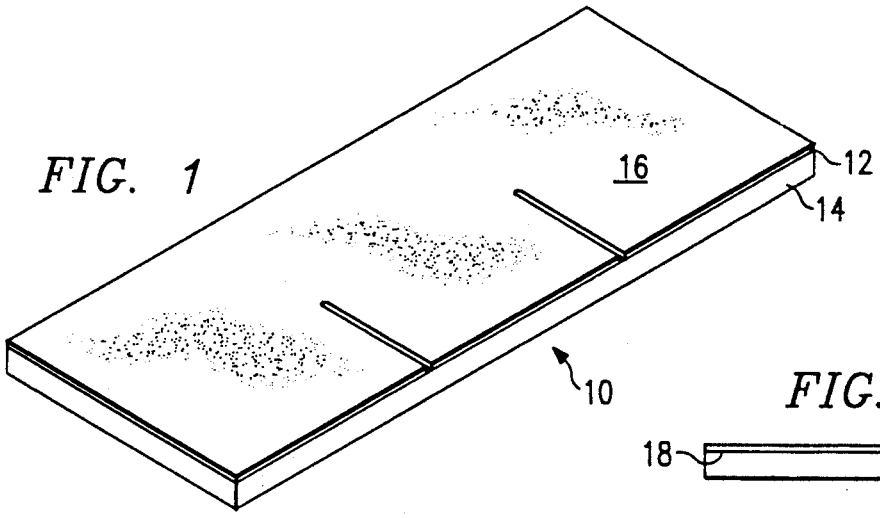
FIG. 1 is a perspective view of a roofing shingle formed in accordance with the teachings of the present invention.
Figure 2:
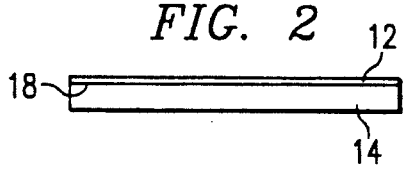
FIG. 2 is a cross sectional view of the roof shingle illustrating its composition.

With references to FIGS. 1 and 2, a roofing shingle 10 formed in accordance with the teachings of the present invention is illustrated. With reference to FIG. 2, the roofing shingle can be seen to comprise an upper layer 12 formed of conventional asphalt composite shingle materials and a lower layer 14 formed of a foamed polymer, such as urethane. The granule impregnated upper surface 16 of layer 12 is exposed to the elements. The upper surface of layer 14 is bonded to the underside 18 of layer 12 to prevent the separation of the layers in service as will be discussed hereinafter. In use, the shingle 10 can be attached to the roof by conventional techniques, including roof nails or staples.

Generally, the use of a multi-layered roof shingle, having a polymer foam lower layer 14, provides significant advantages. Aesthetically, the increased thickness provides significant visual enhancement of the roof character because of the layering effect. The use of the polymer foam can also provide significant improvement in strength characteristics, including tear resistance, flexibility and cold temperature crack resistance. The foamed polymer can also provide a significant improvement in shingle thermal insulation properties and reduces acoustic noise transfer through the roof. Finally, the flexibility of the foam material is likely to absorb shocks from severe hail and storm damage which could damage conventional asphalt composite or wood shingles. The degree of improvement in these non-aesthetic characteristics is dependent upon the choice and formulation of the foamed polymer.

Conventional asphalt composite shingles are usually made in a hot asphalt coating process as a continuous sheet of composite material in a width appropriate to the coating equipment. The composite sheet of conventional asphaltic composite shingle material consists essentially of a lower layer of asphalt, an intermediate layer of a base selected from the group consisting of fiberglass and felt, an upper layer of asphalt and layer of weather resistant granules. The sheet is fed into a cutting device which cuts individual shingles from the sheet. The present invention contemplates the addition of the polymer foam layer 14 to the under side of a conventional sheet of asphalt composite material after it has been formed into sheet form, and either prior to or after its cutting into individual shingle pieces. However, it is preferred to cut the sheet into individual shingle pieces first, and then apply the foam layer. The method of application of the polymer foam to the asphalt composite sheet includes free blown and froth methods which form the foam on the composite sheet, or adhering a pre-formed foam by conventional flame or adhesive techniques.

Irrespective of the method of forming polymer foam layer 14, the layer 14 is preferably between 1/16 inch and one inch thick. The foam should be sufficiently flexible to avoid detraction from the pliability of conventional asphalt composite shingles. The foam preferably has fire retardant (FR) properties to avoid propagation of under shingle fires or smoldering. The adhesion between the layers 12 and 14 should be sufficient to allow satisfactory line processing such as cutting the sheets into individual shingles and subsequent customer handling. The foam should also exhibit an appropriate dark color to blend into the roof line, or meet aesthetic color styling requirements, as certain edges of the foam is likely to be exposed. Finally, it is most desirable that the foam application methods be compatible with current composite shingle processing technology to utilize existing production lines.

The preferred method of application of the polymer foam to the sheet of composite asphalt material is the free blown method. In this method, the foam, typically urethane, is sprayed on to the under side of the asphalt composite sheet by a metered mixer which mixes in a predetermined quantity of catalyst or initiator as the polymer is blown on to the composite sheet. The foam then develops and cures on the asphalt sheet.

Advantages of the free blown method include the simple adaptation of this method to current composite material production lines and the absence of any heat source required for curing the polymer foam.

In the froth method of application, the polymer is used in a water based system in which air is introduced into the latex polymer in a controlled manner to froth the polymer and the froth mixture is then metered onto the under side of the composite material sheet with a fixed clearance knife or doctor blade.

Advantages of the froth method include the wide variety of polymers which can be used, including acrylics, urethanes, rubbers, vinyl and almost any film forming resin in a water system. The density can be precisely controlled, as can the applied thickness or gauge because of the use of the fixed clearance knife or doctor blade. The wide choice of polymers could allow the selection of a material which does not require a prime coat for proper adhesion to the asphalt composite material sheet. Finally, precision frothing equipment is commercially available from Oakes Machine Corporation, Gusmer and others.

Preformed foam sheets can be bonded to the composite material sheets to form the roofing shingles 10. Any suitable state of the art laminating technique can be employed to bind the two sheets together, including flaming or adhesive lamination. By using a preformed foam, the gauge and density is predictable, and the foam can be precolored as desired.

In one trial undertaken with the teachings of the present invention, the free blown method of foam application was undertaken with a two-part polymer foam system, including a prepolymer of methylene bis (phenyl isocyanate); also known as MDI, polyol or polyamine and Trichlorofluoromethane (Freon 11), mixed in a one-to-one ratio by weight or volume (densities are quite similar) with both components at a temperature of about 160°. A foam system of this type is provided by K. J. Quinn & Company, Inc. of 137 Folly Mill Road, Seabrook, N.H. 03874, as their QC-4860A/B roofing membrane, identified by the trademark QThane. The uncured material is applied with a thickness about one quarter of the desired final thickness after curing.

Table I provides experimental results of performance criteria at five different positions on the roofing shingles made in the test. Also provided is an average of the five test results and a comparison to a test result for just the asphalt composite material part of the shingle. Test measurements were made in the machine direction (MD) corresponding to the direction of movement of the sheet prior to cutting into individual shingles and along the cross machine direction (CD) corresponding to the width direction of the sheet.

TABLE I

| | (Grey) QUINN #1 | | (White) QUINN #2 | | (Grey) QUINN #3 | | (Grey) QUINN #4 | | (Black) QUINN #5 | | QUINN Average | | HIP & RIDGE (Control) | |
|---|---|---|---|---|---|---|---|---|---|---|---|---|---|---|
| | MD | CD | MD | CD | MD | CD | MD | CD | MD | CD | MD | CD | MD | CD |
| Tensile: (lbs/1") | | | | | | | | | | | | | | |
| 30° F. | 29 | 34 | 100+ | 100+ | 43 | 55 | 41 | 48 | 48 | 50 | 52.2+ | 60.4+ | 39 | 13 |
| 77° F. | 37 | 67 | 100+ | 68 | 41 | 55 | 59 | 66 | 72 | 47 | 61.8+ | 60.6 | 30 | 18 |
| 120° F. | 35 | 54 | 100+ | 100+ | 47 | 42 | 40 | 50 | 33 | 19 | 51.0+ | 53.0+ | 30 | 14 |
| Elongation: (1%) | | | | | | | | | | | | | | |
| 30° F. | 433 | 450+ | 465+ | 460+ | 454+ | 458+ | 415 | 466+ | 476+ | 471+ | 448.8+ | 461.0+ | — | — |
| 77° F. | 467+ | 426+ | 472+ | 468 | 388 | 485+ | 431+ | 467+ | 467 | 469 | 445.0+ | 463.0+ | — | — |
| 120° F. | 365+ | 411+ | 700+ | 683+ | 371 | 521+ | 335 | 452 | 319 | 471+ | 418.0+ | 507.6+ | — | — |
| Foam Adhesion: (lbs/1") | | | | | | | | | | | | | | |
| 30° F. | 2.50 | 1.13 | 0.50 | 0.63 | 1.00 | 1.00 | 1.00 | 0.90 | 1.00 | 1.17 | 1.20 | 0.97 | — | — |
| 77° F. | 4.00 | 1.13 | 3.50 | 1.50 | 3.00 | 2.00 | 2.50 | 1.00 | 3.00 | 1.00 | 3.20 | 1.33 | — | — |

TABLE I-continued

| | (Grey) QUINN #1 | | (White) QUINN #2 | | (Grey) QUINN #3 | | (Grey) QUINN #4 | | (Black) QUINN #5 | | QUINN Average | | HIP & RIDGE (Control) | |
|---|---|---|---|---|---|---|---|---|---|---|---|---|---|---|
| | MD | CD | MD | CD | MD | CD | MD | CD | MD | CD | MD | CD | MD | CD |
| 77° F. (Aged) | 0.50 | 0.50 | 0.75 | 0.33 | 0.75 | 0.50 | 0.50 | 0.45 | 0.50 | 0.50 | 0.60 | 0.46 | — | — |
| 120° F. | 2.75 | 0.50 | 2.50 | 0.25 | 1.75 | 1.50 | 1.50 | 0.33 | 2.25 | 0.50 | 2.10 | 0.62 | — | — |
| Tongue Tear: (lbs) | | | | | | | | | | | | | | |
| 30° F. | 18 | 15 | 31 | 25 | 19 | 14 | 20 | 23 | 20 | 26 | 21.6 | 20.6 | 2.8 | 2.2 |
| 77° F | 11 | 19 | 30 | 26 | 22 | 24 | 28 | 19 | 15 | 24 | 21.2 | 22.4 | 2.7 | 3.3 |
| 120° F. | 16 | 11 | 26 | 22 | 12 | 14 | 15 | 19 | 17 | 26 | 17.2 | 18.4 | 1.6 | 2.8 |
| Staple Pull: (lbs) | | | | | | | | | | | | | | |
| 30° F. | 75 | | 100+ | | 100+ | | 65 | | 73 | | 82.6+ | | 52 | |
| 77° F. | 62 | | 70 | | 87 | | 84 | | 90 | | 78.6 | | 26 | |
| 120° F. | 65 | | 67 | | 60 | | 70 | | 75 | | 67.4 | | 27 | |
| **Mandrel: (2") | up/dn | up/dn | up/dn | up/dn | up/dn | up/dn | up/dn | up/dn | up/dn | up/dn | | | up/dn | up/dn |
| 30° F. | P/P | P/F | P/F | P/P | P/F | P/P | P/F | P/F | P/P | P/F | | | P/F | P/F |
| 77° F. | P/P | P/P | P/P | P/P | P/P | P/P | P/P | P/P | P/P | P/P | | | P/P | P/P |
| 120° F. | P/P | P/P | P/P | P/P | P/P | P/P | P/P | P/P | P/P | P/P | | | P/P | P/P |
| Stiffness: (Cantilever) | | | | | | | | | | | | | | |
| 30° F. | 15+/15+ | = | = | = | = | = | = | = | = | = | | | 11.0/11.5 | 10.25/11.0 |
| 77° F. | 15+/15+ | = | = | = | = | = | = | = | = | = | | | 0.25/0.25 | 7.5/9.0 |
| 120° F. | 15+/15+ | = | = | = | = | = | = | = | = | = | | | 5.75/6.5 | 5.5/6.25 |
| U.L. Seal Test | Very Good | | Excellent | | Excellent | | Good | | Very Good | | | | Excellent | |
| Total Weight (Lbs/Sq.) | 110.3 | | 107.5 | | 115.0 | | 115.3 | | 128.6 | | | | Target 68 (?) | |
| Foam Weight (Lbs/Sq.) | 34.3 | | 34.6 | | 34.6 | | 37.0 | | 54.0 | | | | — | |
| Total Gauge (inches) | 5/16 | | 3/16 | | 3/16 | | ¼ | | 3/16 | | | | — | |
| Foam Gauge (inches) | ¼ | | ⅛ | | ¼ | | 3/16 | | ⅛ | | | | — | |

*5 hrs. in 115° F. Water)
**up = granule surface exposed; dn = foam [back] surface exposed; P = passed [no cracking]; F = failed [surface cracked]

The tensile strength tests are conducted in accordance with ASTM Standard D-751. Preferably, the shingle should exhibit adhesive strength of the bond between the upper and lower layers sufficient to prevent separation during manufacture and in field handling and service under normal circumstances.

In addition to the tongue tear test undertaken, Elmendorf and Trapazoid tear tests could be employed as well. In any event, the construction must be sufficiently pliable and tear resistant to withstand normal handling and installation practices in the roofing industry.

In summary, the test results indicate that the roofing shingle constructed in accordance with the present invention provides significant increases in the tensile strength, tear strength and staple pull resistance as compared to conventional composite shingles. The cantilever stiffness test indicates that the shingle 10 exhibits an initial higher degree of stiffness and tends to remain relatively unchanged over a wide temperature range as compared to a standard shingle.

A wind tunnel test was also conducted on a test roof having the subject shingles. The roof deck was conditioned at 140° F. for sixteen hours prior to the testing. The test was conducted at wind speeds of 60 mph for two hours and at 100 mph for ten minutes. No failure was evidenced.

Figure 3:
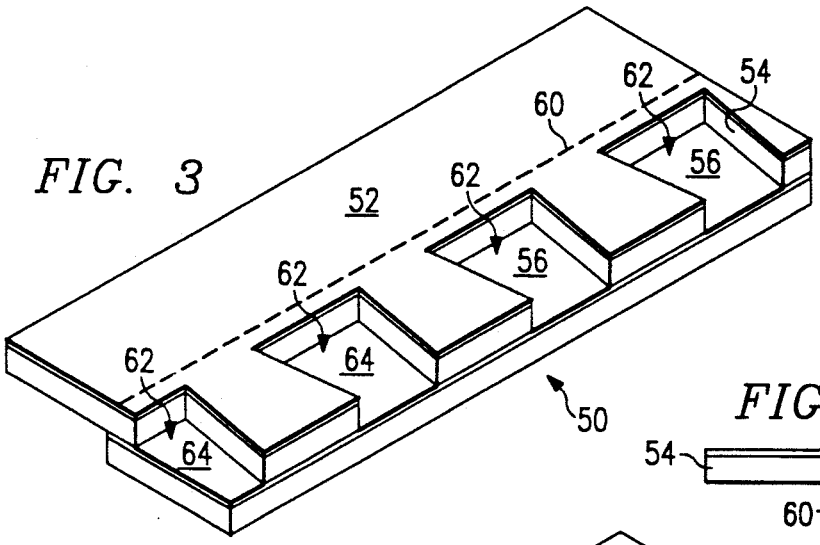
FIG. 3 is a perspective view of a first modification of the roofing shingle having multiple layers.
Figure 4:
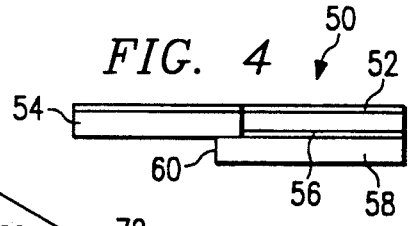
FIG. 4 is an end view of the shingle of FIG. 3.

With reference now to FIGS. 3 and 4, a roofing shingle 50 forming a first modification of the present invention is illustrated. The roofing shingle 50 has multiple layers of asphaltic shingle material and polymer foam to enhance the appearance of the shingle. More specifically, shingle 50 includes an upper layer 52 of asphaltic shingle material, intermediate layer 54 of polymer foam, intermediate layer 56 of asphaltic shingle material and a lower layer 58 of polymer foam. As can be seen in the drawings, the layers 56 and 58 extend only back to a line 60. Also, notches 62 are cut through the upper layer 52 and intermediate layer 54 to expose the surface 64 of the intermediate layer of asphaltic roofing material 56 at the bottom of the notches. The notches provide an enhanced aesthetic effect to the roofing shingle 50.

Figure 5:
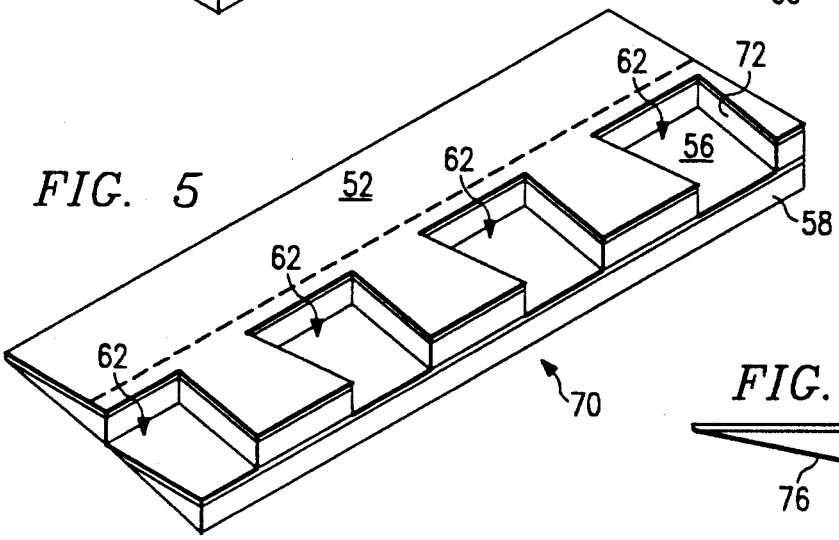
FIG. 5 is a perspective view of a second modification of the roofing shingle having tapered multiple layers.
Figure 6:
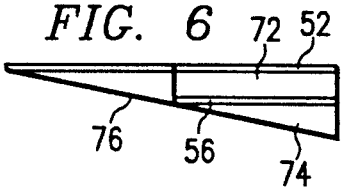
FIG. 6 is an end view of the shingle of FIG. 5.

With reference now to FIGS. 5 and 6, a roofing shingle 70 is illustrated forming a second modification of the present invention. Certain portions of roofing shingle 70 correspond to those previously described in roofing shingle 50, and are identified by the same reference numerals. However, in roofing shingle 70, the two polymer foam layers 72 and 74 are tapered from their front edge to define an essentially planer lower surface 76 to the shingle. Preferably, the foam layer tapers from a thickness of about 1/16 inch to one inch from the front edge of the shingle, to zero thickness about 60% of the distance from the front edge to the back edge of the shingle. It will be understood that roofing shingles 50 and 70 can be made in substantially the same process as described previously for roofing shingle 10.

Although a single embodiment of the invention has been illustrated in the accompanying drawings and described in the foregoing detailed description, it will be understood that the invention is not limited to the embodiment disclosed, but is capable of numerous rearrangements, modifications and substitutions of parts of elements with departing from the spirit and scope of the invention

We claim:

1. A method for making a thickened roofing shingle to enhance the appearance of a roof by providing enhanced relief comprising the steps of:

bonding a layer of flexible polymer foam to one side of a composite sheet of conventional asphalt composite shingle material consisting essentially of a lower layer of asphalt, an intermediate layer of a base selected from the group consisting of fiberglass and felt, an upper layer of asphalt and a layer of weather resistant granules;

curing the foam so that the layer of polymer foam has a cured thickness of about 1/16th inch to 1 inch; and cutting the composite sheet and bonded polymer foam into individual pliable weatherproof shingles having an enhanced relief to enhance the appearance of a roof to which the shingle is attached wherein the foam is flexible and does not detract from the pliability of the composite sheet.

2. The method of claim 1 wherein the step of bonding the polymer foam to the composite sheet comprises the step of forming the foam on the composite sheet by a free blown process.

3. The method of claim 1 wherein the step of bonding the polymer foam on the composite sheet includes the step of forming the polymer foam on the composite sheet by a froth process.

4. The method of claim 1 further comprising the steps of preforming the polymer foam before bonding to the composite sheet, said step of bonding including the step of adhering the polymer foam to the composite sheet with an adhesive.

5. A method for making a roofing shingle comprising the steps of:

providing a first composite sheet of conventional asphalt composite shingle material consisting essentially of a lower layer of asphalt, an intermediate layer of a base selected from the group consisting of fiberglass and felt, an upper layer of asphalt and layer of weather resistant granules;

providing a second composite sheet of conventional asphalt composite shingle material consisting essentially of a lower layer of asphalt, an intermediate layer of a base selected from the group consisting of fiberglass and felt, an upper layer of asphalt and a layer of weather resistant granules;

bonding a first layer of flexible polymer foam to an underside of the first composite sheet and to an upper surface of the second composite sheet;

bonding a second layer of flexible polymer foam to an underside of the second composite sheet;

curing the polymer foams, each cured polymer foam layer having a thickness of about 1/16th inch to one inch;

coloring said first and second continuous layers of polymer foam an appropriate dark color to blend into the roof line; and cutting the bonded composite sheets and bonded polymer foam layers into individual pliable shingles wherein the first foam layer does not detract from the pliability of the first composite sheet and the second foam layer does not detract from the pliability of the second composite sheet.

6. The method of claim 5 wherein the step of cutting the bonded composite sheets are bonded polymer foam layers into individual shingles further comprises the step of cutting notches through the first composite sheet and first polymer foam layer to expose the upper surface of the second composite sheet at the bottom of the notches.

7. The method of claim 1 further comprising the step of preparing the polymer foam to have a dark color.

8. The method of claim 1 wherein the polymer foam layer tapers from a leading edge of each shingle toward an opposite edge of each shingle.

* * * * *

UNITED STATES PATENT AND TRADEMARK OFFICE

CERTIFICATE OF CORRECTION

PATENT NO. : 5,232,530

DATED : August 3, 1993

INVENTOR(S) : Malmquist et al.

It is certified that error appears in the above-identified patent and that said Letters Patent is hereby corrected as shown below:

Column 1, Summary of the Invention, line 42, delete the word --or-- and insert the word --of--.

Column 3, line 5, insert the word --a-- after the words --of asphalt and--.

Table I, Elongation, 30° F., delete --448.8+-- and insert --448.6+--.

Table I-continued, Tongue Tear, 30° F., delete --2.8-- and insert --2.6--.

Table I-continued, Stiffness, 77° F., delete --0.25/-- and insert --8.25/--.

Table I-continued, Stiffness, 77° F., delete second --0.25 -- and insert --9.25--.

Column 5, line 56, delete the word --s+andard-- and insert the word --standard--.

Signed and Sealed this

Nineteenth Day of April, 1994

Bruce Lehman

*Attest:*

BRUCE LEHMAN

*Attesting Officer*

*Commissioner of Patents and Trademarks*